US009446832B2

(12) United States Patent
Guglielmo

(10) Patent No.: US 9,446,832 B2
(45) Date of Patent: Sep. 20, 2016

(54) APPARATUS AND METHOD FOR THE CONTROL OF ENGINE THROTTLE FOR INBOARD AND OUTBOARD BOAT MOTORS

(71) Applicant: Enovation Controls, LLC, Tulsa, OK (US)

(72) Inventor: Kennon Guglielmo, San Antonio, TX (US)

(73) Assignee: Enovation Controls, LLC, Tulsa, OK (US)

( * ) Notice: Subject to any disclaimer, the term of this patent is extended or adjusted under 35 U.S.C. 154(b) by 0 days.

(21) Appl. No.: 14/303,688

(22) Filed: Jun. 13, 2014

(65) Prior Publication Data

US 2014/0295718 A1 Oct. 2, 2014

Related U.S. Application Data

(63) Continuation of application No. 13/290,969, filed on Nov. 7, 2011, now abandoned.

(60) Provisional application No. 61/410,784, filed on Nov. 5, 2010.

(51) Int. Cl.
*B63H 21/21* (2006.01)
*B63H 21/22* (2006.01)

(52) U.S. Cl.
CPC ..... *B63H 21/213* (2013.01)

(58) Field of Classification Search
CPC ..... B63H 21/213; B63H 21/21; B63H 2021/216; B63H 21/22; B63H 21/24
USPC ..... 440/84, 87
See application file for complete search history.

(56) References Cited

U.S. PATENT DOCUMENTS

| | | | |
|---|---|---|---|
| 3,085,447 | A | 4/1963 | Shay |
| 3,378,804 | A | 4/1968 | Cartwright |
| 3,940,674 | A | 2/1976 | Gill |
| 4,706,006 | A | 11/1987 | Solomon |
| 4,962,717 | A | 10/1990 | Tsumiyama |
| 5,090,929 | A | 2/1992 | Rieben |
| 5,362,269 | A | 11/1994 | Leach |
| 6,230,642 | B1 | 5/2001 | McKenney et al. |
| 6,375,522 | B1 | 4/2002 | Bellens et al. |
| 6,538,217 | B1 | 3/2003 | Eriksen |
| 6,684,803 | B1 | 2/2004 | Dickson |
| 6,812,816 | B1 | 11/2004 | Easton |
| 6,865,996 | B2 | 3/2005 | Borrett, Jr. |
| 6,896,563 | B1 | 5/2005 | Dickson |
| 6,914,543 | B2 | 7/2005 | Floros et al. |

(Continued)

FOREIGN PATENT DOCUMENTS

| | | |
|---|---|---|
| WO | WO2007055605 | 5/2007 |
| WO | WO2011049470 | 4/2011 |

*Primary Examiner* — Anthony Wiest
(74) *Attorney, Agent, or Firm* — William H. Quirk; Jesse L. Frizzell; Rosenthal Pauerstein Sandoloski Agather LLP

(57) ABSTRACT

A ski boat throttle control system incorporating a rotary assembly such as a thumbwheel within the control lever knob which is part of the control lever assembly that is gripped and held by the operator of the boat during use. The incorporation of such a thumbwheel assembly allows the operator to make more controlled adjustment to the speed of the boat when the boat is in normal operational mode and to intuitively make adjustments to the cruise control speed of the boat when in cruise control.

20 Claims, 4 Drawing Sheets

(56) References Cited

U.S. PATENT DOCUMENTS

| | | | |
|---|---|---|---|
| 7,201,620 | B2 | 4/2007 | Kinoshita et al. |
| 7,467,595 | B1 | 12/2008 | Lanyl |
| 7,548,697 | B2 | 6/2009 | Hudson et al. |
| 7,549,900 | B2 | 6/2009 | Kinoshita et al. |
| 8,092,264 | B2 | 1/2012 | Kinoshita et al. |
| 8,572,940 | B2 | 11/2013 | Schmidt et al. |
| 2007/0277721 | A1 | 12/2007 | Crptts |
| 2008/0269968 | A1* | 10/2008 | Stewart ..... 701/21 |
| 2009/0215334 | A1 | 8/2009 | Suzuki et al. |
| 2011/0294375 | A1 | 12/2011 | Kuriyagawa et al. |

* cited by examiner

APPARATUS AND METHOD FOR THE CONTROL OF ENGINE THROTTLE FOR INBOARD AND OUTBOARD BOAT MOTORS

CLAIM OF PRIORITY TO PRIOR APPLICATION

This application claims the benefit of the filing date of U.S. Non-Provisional application Ser. No. 13/290,969, filed on Nov. 7, 2011, entitled "Apparatus and Method for the Control of Engine Throttle for Inboard and Outboard Motors," the entirety of which is hereby incorporated by reference into the present disclosure; as well as U.S. Provisional Application Ser. No. 61/410,784, filed on Nov. 5, 2010, entitled "Apparatus and Method for the Control of Engine Throttle for Inboard and Outboard Boat Motors", the entire disclosure of which is hereby incorporated by reference into the present disclosure.

FIELD OF THE INVENTION

The present invention primarily pertains to the field of sporting competition and recreational boats, commonly known as sport ski boats, and, more particularly, to speed control systems and related methods for sport ski boats.

BACKGROUND

For terminology purposes of this application, we will use the term "ski boat" (occasionally "sport ski boat") to refer to any watercraft that falls within the common understanding of a ski boat, a sport ski boat (also known as "sport/ski" or "sport-ski" boats), a tow boat, or any comparable watercraft such as are designed and used for towing recreational or competition water skiers, barefooters, kites, wakeboarders, or tubers, irrespective of whether a particular boat is ever actually used for such purposes, and even though such boats may instead be used for other purposes such as fishing, cruising, patrolling, transport or the like.

Most ski boats, whether powered by inboard or outboard motors, utilize at least two relatively standard systems for the control of the boat and its propulsion system—a steering system and an engine throttle/shift system. Design and performance of the throttle/shift system faces a surprisingly complex array of challenges, not the least of which has long been the difficulty of providing a system that can be controlled to interface with the propulsion system in a way that enables easy, accurate and reliable changes in boat speed in all conditions. So often, what is intended as a slight speed adjustment produces an inordinate reaction from the propulsion system which is all the more exacerbated by the operator's typical overcorrection in response. Harsh weather or choppy seas typically make the commensurate problems worse. In addition to typical challenges at low speeds, most marine propulsion systems also have less-predictable speed ranges where it is more difficult to achieve small changes in the speed by adjusting the throttle position.

Cruise control systems can sometimes help at greater speeds, but a ski boat operator experiences a secondary challenge when, in the moment, he wants to slightly adjust the "set" speed for the cruise control. Existing cruise control adjustment mechanisms are nice, but they are not intuitive enough. Too often, what starts in the operator's mind as a desire to slightly adjust the cruise speed instead results in a sequence of adjusting, disengaging, adjusting, reengaging, disengaging, etc. As a result of these and other operator challenges, an operator cannot easily and intuitively adjust the cruise control speed once it has been set, and better controls have long been needed.

Many other problems, obstacles, limitations and challenges of the prior art will be evident to those skilled in the art, particularly in light of the prior art.

BRIEF SUMMARY OF THE INVENTION

The present invention provides an improved apparatus and method of use for a ski boat speed control lever, often referred to as a boat "throttle lever" or "throttle handle", and related watercraft systems. While typical throttle levers also incorporate forward/reverse gear shifting controls, the present invention retains such functionality and improves upon the basic throttle/shift control lever by incorporating a thumbwheel or equivalent adjustment control into the handle structure of the throttle/shift lever. The rotary thumbwheel control is operable to enhance functionality in conjunction with both normal running mode and with cruise control mode.

Presently preferred embodiments of the present invention, which will be described subsequently in greater detail, generally comprise a control thumbwheel assembly within the control lever knob which is part of the control lever assembly that is gripped and held by the operator of the boat during the control and handling of the watercraft in motion. The incorporation of a control thumbwheel assembly allows the operator to make thumbed adjustment to the speed of the boat when the boat is in normal operational mode and to make thumbed adjustments to the cruise control speed of the boat when in cruise control operation.

The apparatus and method for the thumbed adjustment of engine throttle or boat speed according to the present invention substantially departs from the conventional concepts and designs of the prior art, and in so doing provides an apparatus that has many advantages and novel features which are not anticipated, rendered obvious, suggested, or even implied by any of the prior art, either alone or in any obvious combination thereof.

In this respect, before explaining at least one embodiment of the invention in detail, it is to be understood that the invention is not limited in its application to the details of construction and to the arrangements of the components set forth in the following descriptions or illustrated in the drawings. The invention is capable of many other embodiments and of being practiced and carried out in numerous other ways. Also, it is to be understood that the phraseology and terminology employed herein are for the purpose of the description and should not be regarded as limiting.

Other objects, features and advantages of the present invention will become evident to the reader and it is intended that these objects, features and advantages are within the scope of the present invention.

To the accomplishment of all the above and related objectives, it should be recognized that this invention may be embodied in the form illustrated in the accompanying drawings, attention being called to the fact, however, that the drawings are illustrative only, and that changes may be made in the specifics illustrated or described.

DETAILED DESCRIPTION

Figure 1:
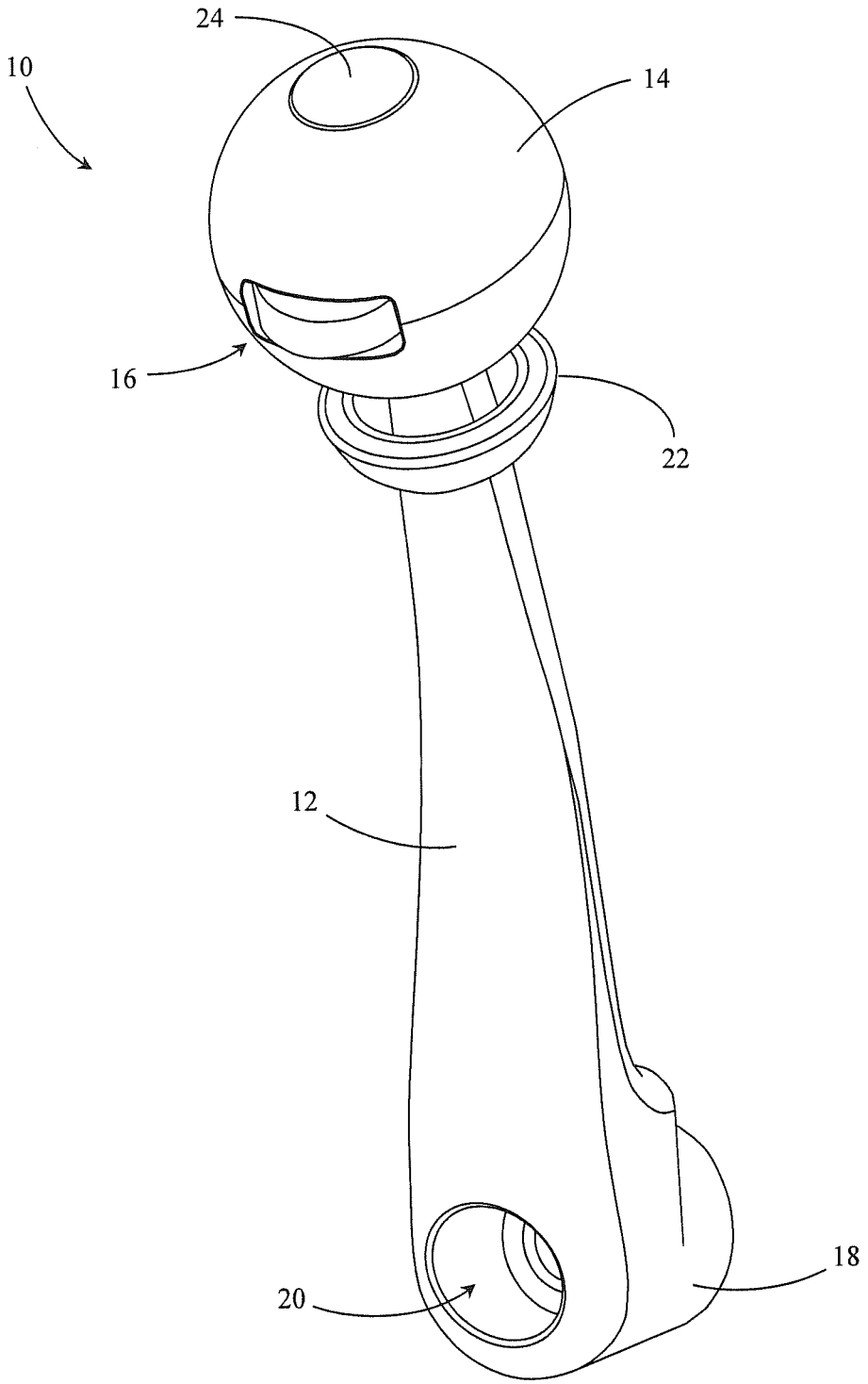
FIG. 1 is a perspective view of the throttle, shift, and cruise control lever 10 of a preferred embodiment of the present invention.

Reference is made first to FIG. 1 for a brief description of the overall structure of the improved throttle/shift lever assembly 10 of the preferred embodiment. Control lever assembly 10 is generally comprised of control lever arm 12 which supports and retains at one end (its "distal" end), control lever knob 14. Within control lever knob 14 is positioned thumbwheel assembly 16 described in more detail below as the primary structure of the present invention. Control lever knob 14 is that part of control lever assembly 10 that is gripped and held by the operator of the boat during the control and handling of the watercraft in motion across the water. An alternative to the thumbwheel assembly 16 described in more detail below, the thumbwheel assembly 16 may also be embodied as a rollerball assembly or other rotatable member or similarly functioned assembly as defined and understood by those skilled in the art to achieve some or all of the functions of thumbwheel assembly 16. Such alternatives should fall within the scope of some (but not necessarily all) aspects of the present invention, except to the extent clearly excluded by the claims.

Opposite the distal end of arm 12, control lever assembly 10 is pivotally mounted at its proximal end relative to the wall 30 of boat 100. The proximal, pivoting end of control lever arm 12 is control lever pivot section 18 which, in a preferred embodiment, is an open cylindrical enclosure that is fit on, or attached to, a rotating shaft connected to the balance of the throttle/shift control system for the boat motor. Control shaft attachment aperture 20 extends through control lever pivot section 18 and may incorporate appropriate set screws, lock washers, or other pivoting attachment means for securing control lever assembly 10 to the balance of the boat motor control system. As described in more detail below, electrical conductors and mechanical linkages extend through control lever arm 12 to points of attachment within the balance of the control mechanism.

Also shown positioned on control lever assembly 10 are neutral lock release ring 22 and cruise control button 24. Neutral lock release ring 22 provides a mechanism whereby control lever arm 12 may be moved from an upright (defined as 0° orientation) position to be released and rotated forward or backward to control the forward and reverse shifting and throttle functions for the motor control. Neutral lock release ring 22 in the preferred embodiment involves a mechanical linkage to any of a variety of mechanisms known in the art for fixing control lever arm 12 in the upright position unless the lock release ring 22 is drawn upward, typically against a spring action return force.

Cruise control button 24 comprises a push button electrical switch that may activate or de-activate the cruise control functionality associated with the electronic engine control unit operable in conjunction with the system of the present invention. As is typical in conjunction with such cruise control systems, activation and de-activation of cruise control may be accomplished by way of the push button switch, or may be de-activated by specified movement of the control lever arm 12 in either the forward or reverse direction. Naturally, LED lights or other indicators (not shown) may be integral with or used in conjunction with button 24 to indicate to the boat captain when or whether the cruise control system is activated.

Figure 2:
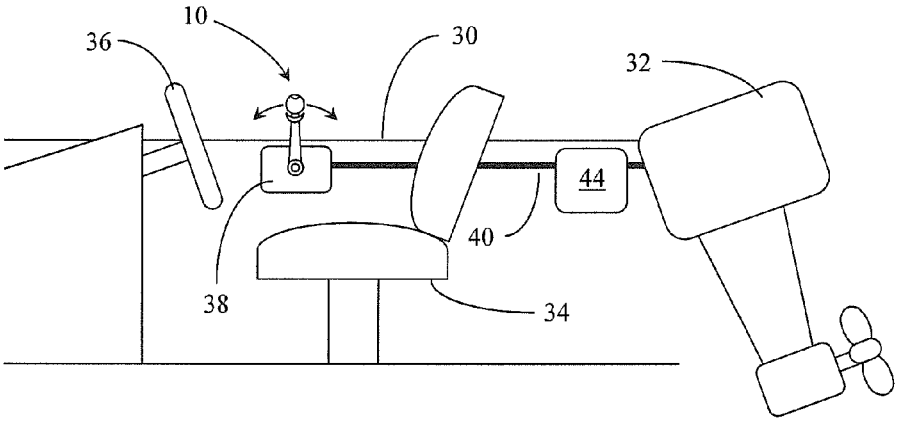
FIG. 2 is a partially schematic side plan view of the placement and positioning of the control lever 10 of FIG. 1, shown operatively employed in conjunction with ancillary operational components on the boat 100.

Reference is now made to FIG. 2 for a partially schematic plan side view showing the placement and positioning of the control apparatus of the present invention installed on and operable in conjunction with various components typical with a ski boat. In FIG. 2, control lever assembly 10 is shown fixed in position on the interior boat hull wall 30 at a point within comfortable arm's reach slightly in front of and to the side of boat captain's chair 34. As is typical, the chair 34 is positioned behind (i.e., toward the stern) and adjacent boat steering control 36, shown as a steering wheel. Control lever assembly 10 is positioned on and operable in conjunction with control lever base unit 38. Control lever base unit 38 may be any of a number of different control units used in ski boat applications, either mechanical or electronic or some combination thereof, that interfaces between the mechanical and electrical connections within control lever assembly 10 and the balance of the control system associated with operation of the boat motor. In FIG. 2, boat motor 32 is shown as an outboard motor, for example, although the boat motor control apparatus and methods associated with the present invention are equally operable in conjunction with both outboard and inboard type motors.

Connecting control lever assembly 10 positioned on control lever base unit 38 to boat motor 32 are control signal wires/cables 40 which pass from control lever base unit 38 through electronic engine control unit (ECU) 44. Control signal wires/cables 40 then continue from electronic engine control unit 44 directly to the mechanical and electronic control elements associated with boat motor 32. The placement, distribution and positioning of electronic engine control unit 44 may vary between different types of boats having different types of motors and engines. In some cases, engine control unit 44 is actually incorporated within the boat motor cowling and may be positioned directly on the motor assembly. In other cases, control unit 44 may be fully incorporated within control lever base unit 38. Numerous other arrangements will also be understood.

It should also be recognized that the present invention may be embodied as an entire boat 100 (with assembly 10 installed), or may be embodied as a throttle lever assembly 10 with or without separately installed process chips or software modules. The apparatus and methods of the present invention are operable in conjunction with any of these different placements and functions of the engine control unit. The only requirement, to the extent expressly required by the claims, is that the engine control unit (or equivalent) is able to receive a signal from the thumbwheel control assembly 16 of the present invention and translate that electronic signal into a modification of the throttle control mechanism on the motor assembly. In general, the same electronic characteristic variable to reflect pivotal movement of arm 12 may be used by the rotary thumbwheel device 26 to signal the engine control unit to adjust the throttle setting. The rotary mechanism 26 provides a much easier and controllable manner of making fine adjustments than can be easily achieved through the typically less sensitive lever movement associated with most standard throttle/shift control mechanisms.

Figure 3:
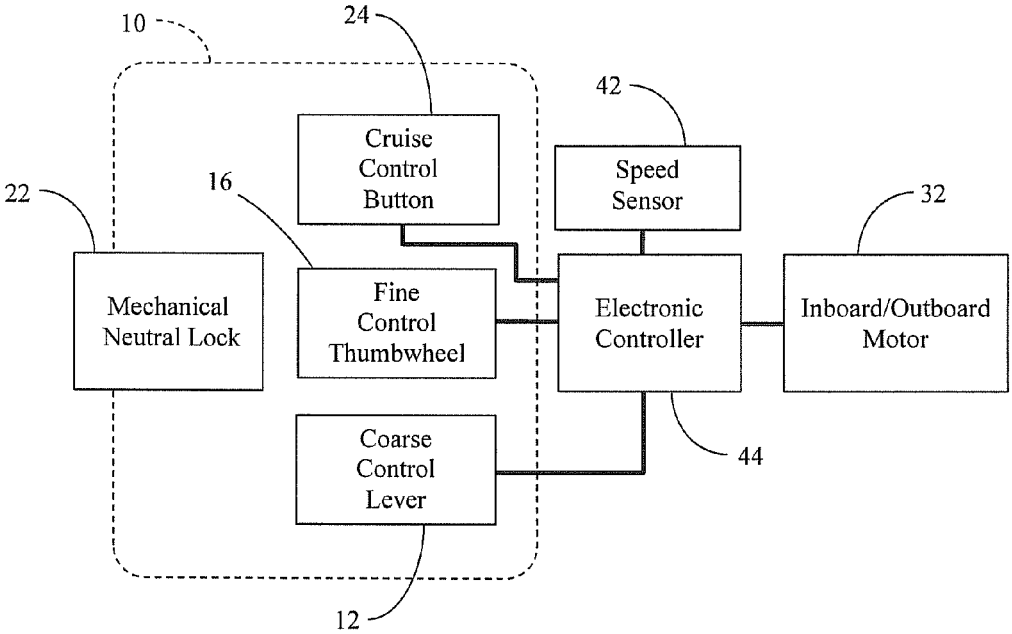
FIG. 3 is a schematic block diagram of the throttle, shift, and cruise control components of the apparatus of the present invention shown in conjunction with the ancillary operational components on the boat.

FIG. 3 is a schematic block diagram of the throttle, shift, and cruise control components of the apparatus of the present invention shown in conjunction with the balance of the ski boat's motor control components. FIG. 3 shows the functional connections between the various components within the system and the operational control achieved through these connections. In FIG. 3 the components associated with control lever assembly 10 are shown within the dotted line border and include cruise control button 24, thumbwheel assembly 16, and control lever 12. Also associated with control lever assembly 10 is neutral lock release ring 22, which in the preferred embodiment, is a mechanical linkage and function.

Electronic controller, or electronic engine control unit (ECU) 44, is in electronic signal connection with cruise control button 24 as well as control thumbwheel assembly 16 and, indirectly, with control lever 12. Cruise control button 24 is typically a single pair of conductors that indicate the status of a basic open/closed switch comprising the activation/de-activation switch for the cruise control functionality. Thumbwheel assembly 16 is connected to engine control unit 44 by an electronic signal connection appropriate for the type of electronic signal transmitted to control unit 44. As described in more detail below, the electronic component rotationally associated with the thumbwheel may be any of a number of different devices suitable for recognizing and translating rotational motion into a recognizable electronic signal.

Control lever 12 provides a mechanical rotational motion to electronic components contained within control lever base unit 38 that likewise provide a signal to engine control unit 44 as is known in the art. Various rheostats, variable resistance devices, or other rotational motion detection devices may be utilized in conjunction with control lever assembly 10 to provide an output signal indicative of the position of control lever 12. In most cases, this output signal is a combination of a rotational orientation that includes both a forward and/or reverse sensor and a degree of rotation sensor. The forward and/or reverse sensors provide the shift signal to the engine control unit and the degree of rotation provides the throttle signal to the control unit. As indicated above, the thumbwheel may provide a higher resolution signal of the same type (resistance, voltage, frequency, etc.) that is associated with the control lever rotational throttle indication. Thumbwheel assembly may alternately provide a distinct signal that the electronic engine control unit may recognize, or may be programmed to recognize, and translate into an output to the throttle control for the motor in a manner similar to, or parallel to, the control throttle output signal. One objective of the present invention is to allow for a more significant mechanical motion to be translated into a finer resolution variation in the throttle signal directed through the motor control system. That is, while it may be difficult to accommodate minute variations in the throttle control by means of the pivoting motion of the control level arm 12, it is easier to manipulate the thumbwheel adjustment control 26 through a greater motion while accomplishing minor adjustments in the throttle control.

The other half of the functionality of the thumbwheel assembly 16 of the present invention is accomplished in coordination with cruise control button 24 and the cruise control system operable within electronic engine control unit 44. As described in detail below in association with the method of operation of the present invention, the thumbwheel assembly 16 operates to immediately change the throttle condition for inboard/outboard motor 32 or to modify the setting for the cruise control system if such has been activated. Speed sensor 42 (shown in FIG. 3), also a typical feature on most modern ski boats, provides input to electronic control unit 44 that allows it to carry out the cruise control system functionality when activated. The basic functional components shown in FIG. 3 therefore operate in a coordinated manner (described in the method below) to achieve greater control over both the active throttle functionality of the watercraft and the cruise control functionality of the watercraft.

Figure 4:
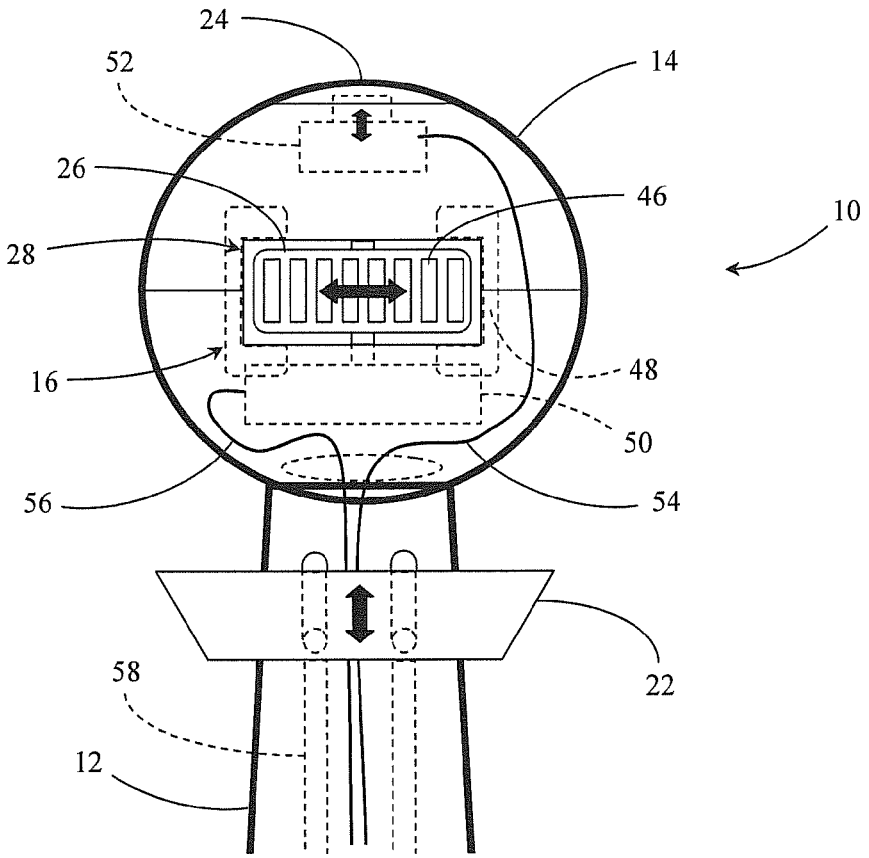
FIG. 4 is a partial cross-sectional side view of the throttle, shift, and cruise control apparatus of the present invention.
Figure 5:
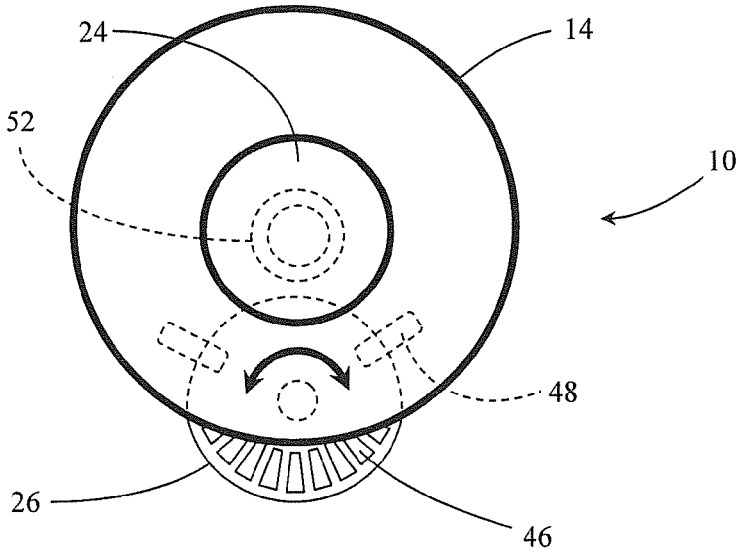
FIG. 5 is a partial cross-sectional top view of the throttle, shift, and cruise control apparatus of the present invention.

Reference is now made to FIGS. 4 and 5 which are partial cross-sectional views of the throttle, shift, and cruise control lever of the preferred embodiment. FIG. 4 is a side view of the top section of control lever assembly 10 disclosing the basic internal structures of the control lever assembly and manner in which they operate to achieve the functions described above. FIG. 4 shows control lever assembly 10 from the side with control lever arm 12 supporting control lever knob 14. Thumbwheel assembly 16 is positioned centrally around the peripheral edge of control lever knob 14. Both control lever arm 12 and control lever knob 14 provide walled enclosures within which are fixed various functional elements, linkages, and electrical/electronic connections.

Thumbwheel assembly 16 is shown to comprise thumbwheel 26 positioned within, and partially extending through, thumbwheel knob aperture 28. Thumbwheel 26 is comprised of a disc shaped thumbwheel, preferably having a knurled or otherwise textured edge, and incorporating ferrous metal index elements 46 positioned in a radial orientation around the perimeter of the wheel 26.

These ferrous metal index elements 46 provide a tactile non-mechanical detent or indexed set of stops when positioned adjacent to index magnets 48. Thumbwheel 26 is therefore free to be rotated by the user while being loosely held in an indexed position by the magnetic forces between the indexing magnets 48 and the ferrous metal index elements 46. Understand that, although the ferrous metal elements 46 are preferably embedded in thumbwheel 26, and elements 48 are preferably magnetic, this arrangement can be reversed in alternative embodiments. Also understand that the number, shape and relative positions of such elements 46 and 48 may well be embodied differently than as illustrated in the drawing.

Although alternatively embodied with a quadrature encoder or other rotary position encoder (described further below), thumbwheel 26 is positioned on a shaft that extends into rotation sensor 50. It is rotation sensor 50 that provides an electrical/electronic signal, by way of rotation sensor signal conductor 56, to the electronic engine control unit (not shown). Rotation sensor 50 may be any number of rotational displacement sensors appropriate for translating a rotation of the thumbwheel into an electronic signal or electrical condition that is sensed by the electronic engine control unit and translated into a fine adjustment of either the engine throttle condition or the cruise control setting, as described above. The combination of thumbwheel 26 and rotation sensor 50 may be of a type that rotates through less than 360° (with rotational end stops) and provides an output directly indicative of the rotational orientation of the device of the thumbwheel.

Alternatively, and preferably, rotation sensor 50 provides infinite degrees of rotation and internal sensors (such as optical sensors) within rotation sensor 50 provide an indication of the degree and the direction of rotation. Perhaps most preferably, sensor 50 may be a quadrature encoder as defined and understood by those skilled in the art. In one embodiment, the quadrature encoder consists of two tracks and two sensors whose outputs are called channels A and B. As the thumbwheel rotates, pulse trains occur on these channels at a frequency proportional to the thumbwheel speed, and the phase relationship between the signals yields the direction of rotation. The relative arrangement and shape of elements 46 and output signals A and B are as defined and understood by those skilled in the art. By counting the number of pulses and knowing the resolution of the thumbwheel 26, the angular motion can be measured. The A and B channels are used to determine the direction of rotation by assessing which channels "leads" the other. A third output channel is used in some alternatives, which yields one pulse per revolution to enable counting full revolutions and as a reference to define a home base or zero position.

It is a preferred embodiment of the present invention to provide for clockwise rotation (as viewed from above) of the thumbwheel 26 to indicate an increase in either throttle or cruise control set speed and counter-clockwise rotation to indicate a decrease. If the control lever assembly 16 of the present invention is placed (as is typical) on the right hand side of the operator of the watercraft 100 (see FIG. 2), then the placement of the protruding portion of thumbwheel 26 on the inside or left hand side of the control lever knob allows the captain of boat 100 to "thumb" the thumbwheel 26 while gripping knob 14 with the right hand. Hence, thumbwheel movement of thumbwheel 26 allows for directional rotation of the thumbwheel in a manner similar to the directional movement of the lever arm 12 for a respective increase or decrease in throttle condition. In such orientation, aperture 28 is positioned on the left lateral side of handle knob 14, referring to "lateral" side as being a left or right side generally aligned (or parallel) to the longitudinal orientation of boat 100.

Also shown in FIG. 4 are the electrical connections associated with cruise control button 24 which provides a condition signal to the electronic engine control unit (not shown) by way of cruise control switch signal conductor 54. Cruise control button 24 is simply a movable component of the control lever knob 14 connected to an internal push button switch 52 as shown. Push button switch 52 is preferably a momentary switch that alters the condition of a conductive wire pair in a manner that signals the electronic engine control unit of a change (activation or de-activation) in the status of the cruise control setting. In the preferred embodiment of the present invention, activation of the cruise control function may be accomplished by pushing cruise control button 24 once, if the cruise control functionality was not already active. Pushing the cruise control button 24 again or while cruise control function is active, will serve to de-activate the cruise control function. In addition, as is typical in such systems, movement of the control lever arm 12 either forward or backwards (reverse) would generally de-activate the cruise control system as being an indication that the boat operator's intent to manually modify the speed of the boat in some manner. On the other hand, manipulation of the thumbwheel 26 would not serve to de-activate the cruise control but would instead serve to change the speed setting at which the cruise control is intended to operate.

Finally shown in FIG. 4 are the mechanical components associated with neutral lock release ring 22. In the example shown in FIG. 4, release ring 22 is mechanically coupled to linkage rods 58 such that the lifting of neutral lock release ring 22 pulls on linkage rods 58 in a manner as to remove a set pin or other mechanical stop (not shown) from a toothed gear or other stop mechanism typically associated with control lever base unit 38. Other possible alternate mechanisms are anticipated for providing the neutral lock functionality to the overall control lever assembly 10.

FIG. 5 shows in greater detail the radial orientation and placement of both thumbwheel 26 and the associated indexing magnets 48. Likewise shown is the centralized placement of push button switch 52 beneath cruise control button 24 forming the top of control lever knob 14.

Figure 6:
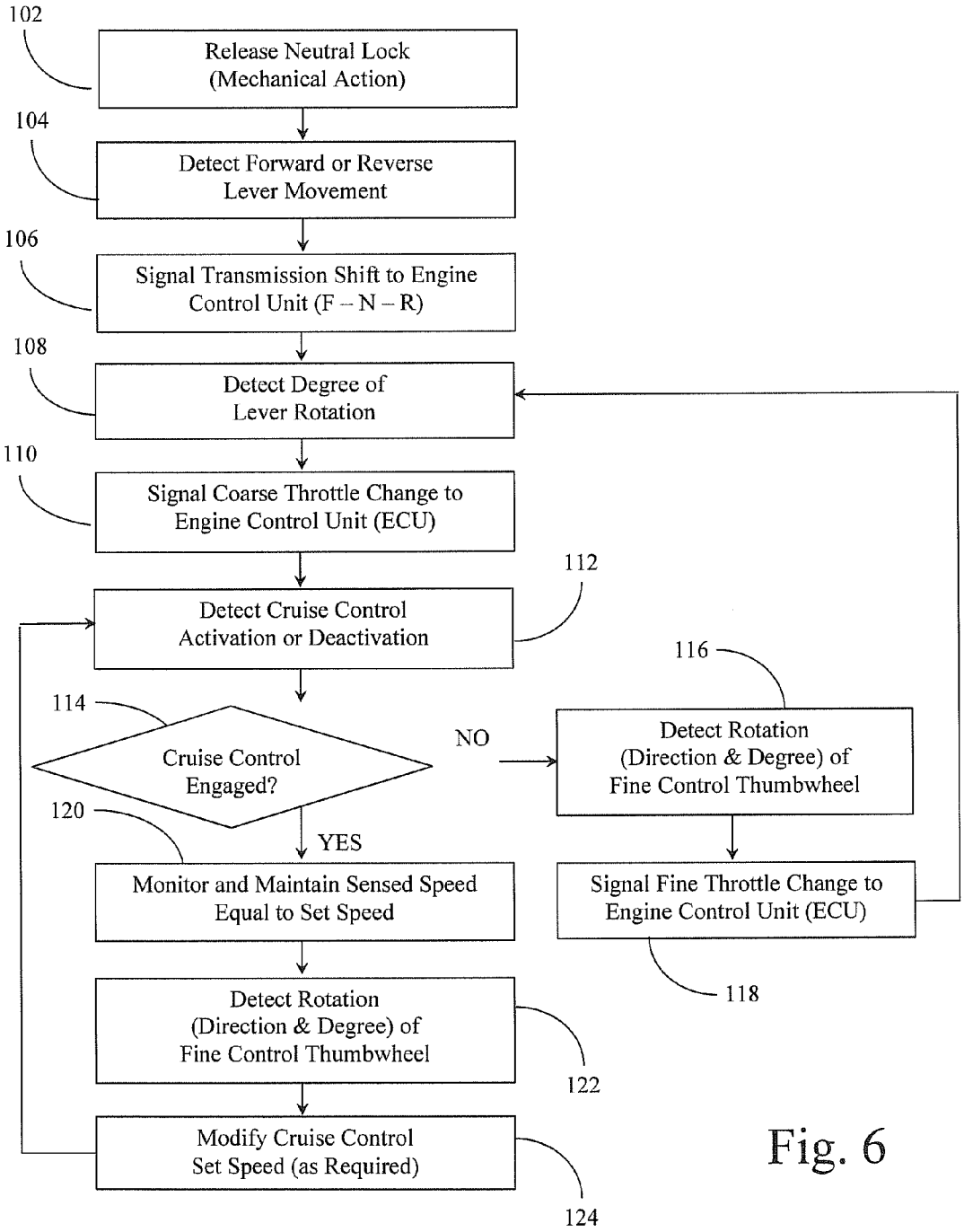
FIG. 6 is a flowchart of the method steps in the operation of the system controlled by the apparatus of the present invention.

Reference is finally made to FIG. 6 for a generalized flowchart providing the basic method steps associated with the operation of the system of the preferred embodiment and its manner of controlling the throttle and shift functions associated with the inboard or outboard boat motor 32. FIG. 6 is intended to describe the dual functionality of the thumbwheel assembly and its manner of effecting fine adjustments to the active throttle status or to the cruise control set speed, depending upon the condition of the cruise control system.

The basic functionality shown in FIG. 6 begins at Step 102 wherein the boat captain directs the release of the neutral lock linkage (a mechanical action) by way of lifting neutral lock release ring 22 as described above. Typically, this action can be achieved by the boat operator with a single hand over the control lever knob with one or more fingers reaching around and underneath the knob to pull the neutral lock release ring upward. Once the neutral lock is released, the operator is free to move the control lever arm forward or backwards to shift out of neutral and initiate throttle action. Step 104 involves the system's initial detection of the forward or reverse lever movement in this regard.

Most engine control systems incorporate not only a rotational displacement to control throttle condition, but also include sensors positioned within control lever base unit 38 to detect the movement of the lever arm either forward or backwards immediately adjacent the neutral position. Upon the detection of the forward or reverse lever movement at Step 104, a signal is transmitted to shift the engine by way of the engine control unit at Step 106. This signal operates to alter the condition of the boat motor from a neutral (typically idling) condition to either a forward shift or reverse shift. The transmission associated with this functionality is typically incorporated within the boat motor assembly.

After detecting the direction of the shift using the control lever assembly, the system then detects at Step 108 the degree of lever rotation accomplished in either forward or reverse. This initiates the transmission of a signal at Step 110 providing a throttle change to the engine control unit (ECU). All of the above represents the typical initial control of the watercraft from a stop or neutral condition to either a forward or a reverse motion. Once in such motion, the system detects whether or not cruise control has been activated at Step 112. Query Step 114 determines if cruise control is engaged, and if not, the system proceeds to the detection of the rotation (direction and degree) of the thumbwheel assembly at Step 116. If any such rotation is detected at Step 116, then a signal is sent comprising the fine adjustment throttle change to the engine control unit (ECU) at Step 118. Subsequent to this fine adjustment of the throttle condition, the process returns to the continued monitoring and detection of the lever rotation at Step 108.

If cruise control has been engaged as determined at query Step 114, then the system monitors and maintains the sensed speed as close to the cruise control set speed as possible at Step 120. In this condition (i.e., cruise control engaged), the detection at Step 122 of the rotation (direction and degree)

of the thumbwheel now effects a change in the cruise control set speed as opposed to a direct alteration of the throttle condition. This is accomplished at Step 124 wherein the cruise control set speed is modified as required by the degree and direction of the thumbwheel rotation. The system then returns to Step 112 wherein ongoing detection of the cruise control activation or de-activation is carried out. It may therefore be seen how the activation or de-activation of the cruise control functionality determines the function of the fine adjustment control thumbwheel. With cruise control not activated, the fine adjustment accomplishes a modification of the throttle condition. With cruise control activated, the thumbwheel effects a fine adjustment of the cruise control set speed. In this manner, the boat operator is able to more accurately and finely control both the actual motion of the boat through the fine adjustment of the throttle condition and the adjustment of the cruise control setting (which in turn effects the fine adjustment of the throttle condition in response to cruise control operation).

It should be understood, though, that the sequence and detail of FIG. 6 are merely exemplary, generalized steps of a preferred process. To the extent still within the scope of the invention as defined in any particular claim, each of those steps 102-124 can be subdivided, combined, transposed, intertwined, eliminated or replaced with equivalents or alternates, as would be known or evident from this description to one of ordinary skill in the art, especially pursuant other teachings known or commercially implemented in the pertinent fields.

The system and methods of the present invention therefore provide a consolidated control mechanism whereby the boat operator is able to maintain control over the operation of the boat from a single hand manipulated device, requiring only the additional handling of the boat steering mechanism. Typical use of the control lever assembly of the present invention would involve the right-handed handling of the control lever assembly by the boat operator and the left-handed handling of the steering mechanism for the boat (see FIG. 2). With the one hand (right hand typical), the boat operator can remove the boat from a neutral condition, direct the boat forward or reverse, make coarse adjustments to the throttle condition in either forward or reverse, make fine adjustments to the throttle condition in either forward or reverse, activate and de-activate the cruise control functionality, and when cruise control functionality is active, make fine adjustments to the set speed at which the cruise control operates. All of this can be achieved by the single-handed manipulation of the control lever arm position 12, thumbwheel 26, ring 22 and button 24 of the present invention.

Although the present invention has been described in conjunction with particular preferred structures, and in conjunction with generalized, preferred methods of operation for these structures, those skilled in the art will recognize many other modifications to the structures and methodology that still fall within the scope of the invention. The specific electrical and electronic functionality associated with components like the rotating thumbwheel 26 and the cruise control button 24 may, for example, be implemented in any number of different ways using a variety of different electronic and/or mechanical components. As long as the engine control unit is appropriately programmed or electronically structured to receive the signals or electrical characteristics from these rotational electronic devices and switches, then any number of different electrical components may be used for these two inventive elements.

Likewise, the mechanical linkages associated with the neutral lock release ring may also be structured in any number of different manners, including rigid connecting rods or flexible connecting cables. Moreover, components like the release ring 22 and associated structures may be replaced by a button switch or linkage or other means, and potentially even entirely eliminated, to the extent not required by a particular aspect of the invention. In some cases, electrical or electronic devices may be used in place of the mechanical linkages described herein. Hard-wired connections can also be replaced with wireless connections to the extent not clearly forbidden by the properly construed claims. Certainly, modifications as to geometry, shape, and size could and likely would vary according to the size and placement of the existing control systems associated with a particular ski boat.

It is also recognized that the systems and methods of the present invention might be implemented in OEM products or as a retrofit device adaptable to any of a number of existing throttle/shift control systems. As briefly described above, in some retrofit environments, intermediate electronics may be necessary to translate the rotational displacement of the fine adjustment thumbwheel to a signal recognizable by an existing electronic control unit. Various signal translators may be provided in order to match the sensor associated with the fine adjustment thumbwheel to the particular signal input requirements of a specific electronic engine control unit. As indicated above, in most cases, this may simply be a higher resolution adjustment of the signal already being received by the electronic engine control unit from the coarse adjustment throttle position sensor associated with the control lever base unit. Such modifications to achieve a retrofit application versus an original equipment system installation will be apparent to those skilled in the art.

Numerous other features, objects, advantages, alternatives, variations, equivalents, substitutions, combinations, simplifications, elaborations, distributions, enhancements, improvements or eliminations (collectively, "variations") will be evident from these descriptions to those skilled in the art, especially when considered in light of a more exhaustive understanding of the numerous difficulties and challenges faced by the art, all of which should be considered within the scope of the invention, at least to the extent substantially embraced by the invention as defined in the claims (including any added claims and any amendments made to those claims in the course of prosecuting this and related applications).

In all respects, it should also be understood that the drawings and detailed description herein are to be regarded in an illustrative rather than a restrictive manner, and are not intended to limit the invention to the particular forms and examples disclosed. Rather, the invention includes all variations generally within the scope and spirit of the invention as claimed. Any current, amended, or added claims should be interpreted to embrace all further modifications, changes, rearrangements, substitutions, alternatives, design choices, and embodiments that may be evident to those of skill in the art, whether now known or later discovered. In any case, all substantially equivalent systems, articles, and methods should be considered within the scope of the invention and, absent express indication otherwise, all structural or functional equivalents are anticipated to remain within the spirit and scope of the present inventive system and method.

What is claimed is:

1. An apparatus for controlling the speed of a ski boat, said ski boat having a propulsion system, and said apparatus comprising:

a. a control lever assembly including a base assembly and a control arm, said control arm having a handle at a distal end thereof, and said control arm being connected at a proximal end to said base assembly, in pivotal relationship with said base assembly;

b. said base assembly being adapted for physical mounting to a ski boat in a fixed orientation on a surface of said ski boat;

c. a thumbwheel assembly within said control lever handle, said thumbwheel assembly comprising a thumbwheel rotatably mounted to said handle in a manner such that a portion of said thumbwheel protrudes beyond a surface of said handle, thereby allowing thumbed rotation of said thumbwheel by a hand otherwise operably gripping said handle;

d. said thumbwheel assembly further comprising controls and circuitry suitable for recognizing and translating rotational motion of said thumbwheel into recognizable signals that are characteristic of a rotational position of said thumbwheel relative to said control lever handle;

e. said control lever assembly being adapted to convey recognizable signals directly or indirectly to said propulsion system for modifying a speed of said ski boat relative to both (1) an angle of pivot of said control lever arm relative to said base assembly and (2) said rotational position of said thumbwheel relative to said control lever handle; and f. wherein thumbed movement of said protruding portion of said thumbwheel may be directed in a direction that is coincident with said forward direction, and wherein rotational movement of said protruding portion in said direction coincident with said forward direction corresponds to fine adjustment of said propulsion system of said ski boat to increase the propulsion provided by said propulsion system.

2. The apparatus of claim 1, wherein:

the controls and circuitry of said thumbwheel assembly are adapted to operate in one of at least two operating modes, one of said modes being characteristic of modifying cruise control parameters and a second mode being characteristic of modifying overall ski boat speed.

3. The apparatus of claim 2, wherein: activation and de-activation of cruise control parameters are accomplished by one of two means:

a. by way of a push button switch; and b. by a specified movement of said control arm.

4. The apparatus of claim 2, wherein: said cruise control parameters are used in conjunction with LED lights indicating whether said cruise control is engaged.

5. The apparatus of claim 1 wherein:

said surface of said handle is on a lateral side surface of said handle such that said thumbwheel is positioned to protrude laterally from said handle.

6. The apparatus of claim 1, wherein: the apparatus is operable in conjunction with either an outboard or inboard type motor.

7. The apparatus of claim 1, wherein: said thumbwheel is embedded with one or more metal indexing elements.

8. The apparatus of claim 7, wherein: said metal indexing elements are magnetic.

9. The apparatus of claim 1, wherein:

a. said signal is a combination of a rotational orientation including both a forward and/or reverse sensor and a degree of rotation sensor;

b. said forward and/or reverse sensors provide a shift signal to an engine control unit; and c. said degree of rotation sensor provides a throttle signal to said control unit.

10. An apparatus for controlling the speed of a ski boat, said apparatus comprising:

a. a control lever assembly including a base assembly and a control arm, said control arm having a handle at distal end thereof, and said control arm being connected at a proximal end to said base assembly, in pivotal relationship with said base assembly;

b. said base assembly being adapted for physical mounting to a ski boat in a fixed orientation on a surface of said ski boat, said ski boat having a propulsion system and an engine control unit;

c. a rotary assembly within said control lever handle, said rotary assembly comprising a rotary member rotatably mounted to said handle in a manner such that a portion of said rotary member protrudes beyond a surface of said handle, thereby allowing thumbed rotation of said rotary member by a hand otherwise operably gripping said handle;

d. said rotary assembly further comprising controls and circuitry suitable for recognizing and translating rotational motion of said rotary member into recognizable signals that are characteristic of a rotational position of said rotary member relative to said control lever handle;

e. said control lever assembly being adapted to convey recognizable signals directly or indirectly to said propulsion system for modifying a speed of said ski boat relative to both (1) an angle of pivot of said control lever arm relative to said base assembly and (2) said rotational position of said rotary member relative to said control lever handle; and f. wherein thumbed movement of said protruding portion of said rotary member may be directed in a direction that is coincident with said forward direction, and wherein rotational movement of said protruding portion of said rotary member in said direction coincident with said forward direction corresponds to fine adjustment of said propulsion system of said ski boat to increase the propulsion provided by said propulsion system.

11. The apparatus of claim 10, wherein said engine control unit is adapted to operate in one of at least two operating modes, one of said modes being characteristic of modifying cruise control parameters and a second mode being characteristic of modifying overall ski boat speed.

12. The apparatus of claim 11 further comprising a mode selector switch positioned on said control lever assembly to be manually accessible by an operator of said ski boat, said mode selector switch being associated with said engine control unit to enable manual selection of said one of said at least two operating modes.

13. The apparatus of claim 12 wherein said rotary assembly is rotatably mounted to said handle in a manner such that a portion of said rotary assembly protrudes beyond a surface of said handle, thereby allowing thumbed rotation of said rotary assembly by a hand otherwise operably gripping said handle, said surface of said handle being on a lateral side surface of said handle such that said rotary assembly is positioned to protrude laterally from said handle.

14. The apparatus of claim 10, wherein: the placement and distribution of said engine control unit operates in one of at least two positions, one of said positions being characteristic of said engine control unit incorporated within a cowling of said boat motor and situated directly on said motor assembly, and a second position being characterized as said engine control unit fully incorporated within a control lever base assembly.

15. The apparatus of claim 10, wherein:

a. said rotary assembly is positioned on a shaft that extends into a rotation sensor;

b. said rotation sensor providing a signal via a rotation sensor signal conductor to said engine control unit;

c. said rotation sensor being functional to translate a rotation of said rotary assembly into said recognizable signal in the form of an electronic signal or electrical condition that is sensed by the engine control unit; and d. said rotary assembly and said rotation sensor providing, in combination, an output directly indicative of a rotational orientation of said rotary assembly.

16. The apparatus of claim 10, wherein:

a. said rotary assembly is embodied with a quadrature encoder;

b. said quadrature encoder consisting of two tracks and two sensors with respective output channels whereby:

i. as said rotary assembly rotates, trains of pulses occur on said respective output channels at frequencies proportional to the speeds of said rotary assembly;

ii. a phase relationship between said trains being indicative of a direction of rotation of said rotary assembly; and iii. the angular motion of said rotary assembly is determinable by counting the number of pulses on said respective output channels.

17. The apparatus of claim 16, further comprising a third output channel yielding one pulse per revolution of said rotary assembly, for counting full revolutions of said rotary assembly and establishing a reference position for said rotary assembly.

18. A ski boat comprising:

a. a propulsion system;

b. a speed control system comprising a control lever assembly including a base assembly and a control arm, said control arm having a handle at a distal end thereof, said control arm being pivotally connected at a proximal end to said base assembly, and said base assembly being adapted for physical mounting to a ski boat in a fixed orientation on a substantially vertical interior wall of said ski boat;

c. a thumbwheel assembly within said control lever handle, said thumbwheel assembly comprising a thumbwheel rotatably mounted to said handle in a manner such that a portion of said thumbwheel protrudes beyond a lateral side surface of said handle such that said thumbwheel is positioned to protrude laterally from said handle surface of said handle, thereby allowing thumbed rotation of said thumbwheel by a hand otherwise operably gripping said handle;

d. said speed control system assembly further comprising controls and circuitry suitable for recognizing and translating rotational motion of said thumbwheel into recognizable signals that are characteristic of a rotational position of said thumbwheel relative to said control lever handle;

e. said speed control system being adapted to operate in one of at least two operating modes, one of said modes being characterized by said recognizable signals causing modification of cruise control parameters, and a second of said modes being characterized by said recognizable signals causing modification of overall ski boat speed;

f. a mode selector switch positioned on said control lever assembly to be manually accessible by an operator of said ski boat, said mode selector switch being associated with said engine control unit to enable manual selection of said one of said at least two operating modes;

g. said control lever assembly being adapted to convey recognizable signals directly or indirectly to said propulsion system for modifying a speed of said ski boat relative to both (1) an angle of pivot of said control lever arm relative to said base assembly and (2) said rotational position of said thumbwheel relative to said control lever handle; and h. wherein thumbed movement of said protruding portion of said thumbwheel may be directed in a direction that is coincident with said forward direction, and wherein rotational movement of said protruding portion of said thumbwheel in said direction coincident with said forward direction corresponds to fine adjustment of said propulsion system of said ski boat to increase the propulsion provided by said propulsion system.

19. The ski boat of claim 18, wherein:

a. said propulsion system includes both a fixed-shaft propeller system as well as a docking thrust system;

b. said speed control system being adapted to control said docking thrust system in response to movement of said thumbwheel relative to said handle; and c. said speed control system being adapted to control said fixed-shaft propeller system in response to pivotal movement of said control arm relative to said base assembly.

20. An apparatus for controlling the speed of a ski boat having a propulsion system, said apparatus comprising:

a. a control lever assembly comprising a base assembly and a control arm, said control arm being positionable in a neutral position relative to said base assembly, and said control arm being pivotally movable in at least a forward direction from said neutral position;

b. said control arm comprising a handle knob and comprising a single elongate shaft having a proximal end and a distal end, said single elongate shaft being connected at said proximal end in pivotal relationship with said base assembly, and said handle knob being connected to said single elongate shaft at said distal end of said single elongate shaft;

c. said handle knob having a spherical shape that is grippable by the hand of a person operating said ski boat, said spherical shape having a diameter wherein said diameter is larger than the largest cross-sectional dimension of said single elongate shaft;

d. said base assembly being adapted for physical mounting to a ski boat in a fixed orientation on a surface of said ski boat, and said base assembly being adapted to allow control connections with said propulsion system of said ski boat such that movement of said handle knob in said forward direction relative to said ski boat corresponds to increased forward thrust by said propulsion system;

e. a thumbwheel assembly within said handle knob, said thumbwheel assembly comprising a thumbwheel rotatably mounted to said handle knob about an axis of rotation parallel to the elongate dimension of said elongate shaft of said control arm, in a position and in a manner such that a portion of said thumbwheel protrudes beyond a lateral surface of said handle knob to allow thumbed movement of said protruding portion of said thumbwheel by a hand otherwise operably gripping said handle knob, said thumbed movement of said protruding portion causing rotational movement of said thumbwheel relative to said handle;

f. said thumbwheel assembly further comprising controls and circuitry suitable for recognizing and translating rotational motion of said thumbwheel into recognizable signals that are characteristic of a rotational position of said thumbwheel relative to said handle knob;

g. said control lever assembly being adapted to convey recognizable signals directly or indirectly to said propulsion system for modifying a speed of said ski boat relative to both (1) an angle of pivot of said control lever arm relative to said base assembly and (2) said rotational position of said thumbwheel relative to said handle knob;

h. wherein thumbed movement of said protruding portion of said thumbwheel may be directed in a direction that is coincident with said forward direction, and wherein rotational movement of said protruding portion of said thumbwheel in said direction coincident with said forward direction corresponds to fine adjustment of said propulsion system of said ski boat to slightly increase the propulsion provided by said propulsion system.

* * * * *